US009279378B2

(12) United States Patent
Katayama et al.

(10) Patent No.: US 9,279,378 B2
(45) Date of Patent: Mar. 8, 2016

(54) APPARATUS FOR DETECTING IMBALANCE ABNORMALITY IN AIR-FUEL RATIO BETWEEN CYLINDERS IN MULTI-CYLINDER INTERNAL COMBUSTION ENGINE

(71) Applicants: Akihiro Katayama, Toyota (JP); Kazuhiro Akisada, Toyota (JP); Leuth Insixiengmai, Nagoya (JP); Sei Maruta, Toyota (JP); Shinichi Nakagoshi, Nisshin (JP); Masahide Okada, Anjou (JP)

(72) Inventors: Akihiro Katayama, Toyota (JP); Kazuhiro Akisada, Toyota (JP); Leuth Insixiengmai, Nagoya (JP); Sei Maruta, Toyota (JP); Shinichi Nakagoshi, Nisshin (JP); Masahide Okada, Anjou (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 0 days.

(21) Appl. No.: 14/186,043

(22) Filed: Feb. 21, 2014

(65) Prior Publication Data

US 2014/0288802 A1 Sep. 25, 2014

(30) Foreign Application Priority Data

Mar. 22, 2013 (JP) ..... 2013-060213

(51) Int. Cl.
*F02M 41/08* (2006.01)
*B60T 7/12* (2006.01)
(Continued)

(52) U.S. Cl.
CPC ..... *F02D 41/0085* (2013.01); *F02D 41/1456* (2013.01); *F02D 41/0082* (2013.01); *F02D 41/0097* (2013.01); *F02D 2200/101* (2013.01)

(58) Field of Classification Search
CPC ..... F02D 41/0082–41/0087; F02D 41/1498; F02D 41/08; F02D 41/14; F02D 41/1454; F02D 41/1456; G01M 15/046; Y02T 10/44
USPC ..... 123/436, 673, 435, 406.24, 406.58, 123/672, 674–675, 690–692, 54.4–55.2, 123/339.19, 687–388, 703, 486; 701/103–107, 110–111; 73/35.09, 73/114.03, 114.04, 114.07, 73/114.25–114.27, 114.49
See application file for complete search history.

(56) References Cited

U.S. PATENT DOCUMENTS 4,348,893 A * 9/1982 Hendrix ..... G01M 15/046 701/102
4,495,920 A * 1/1985 Matsumura ..... F02M 41/125 123/436

(Continued)

FOREIGN PATENT DOCUMENTS

GB 2355814 A * 5/2001 ..... F02D 41/0002
JP 2010-112244 A 5/2010

(Continued)

OTHER PUBLICATIONS

Japanese patent application No. 2012-221463 filed Oct. 3, 2012 (corresponds to U.S. Appl. No. 14/044,400, filed Oct. 2, 2013. Partial English translation is attached as concise explanation.).

*Primary Examiner* — Stephen K Cronin
*Assistant Examiner* — Brian Kirby
(74) *Attorney, Agent, or Firm* — Dinsmore & Shohl LLP

(57) ABSTRACT

An apparatus for detecting imbalance abnormality in an air-fuel ratio between cylinders in a multi-cylinder internal combustion engine is disclosed. The apparatus includes an imbalance determining unit programmed to determine imbalance in an air-fuel ratio of a first cylinder belonging to a cylinder group based upon a difference value between an index value correlative with a crank angular speed detected in the first cylinder and an index value correlative with a crank angular speed detected in a second cylinder belonging to another cylinder group, and further a correction unit programmed to correct the difference value for the first cylinder based upon the index value detected in at least one of other cylinders belonging to the same cylinder group as that of the first cylinder.

3 Claims, 9 Drawing Sheets

(51) Int. Cl.
*F02D 41/00* (2006.01)
*F02D 41/14* (2006.01)

(56) References Cited

U.S. PATENT DOCUMENTS 4,532,592 A * 7/1985 Citron ..... F02D 41/008 123/339.19
4,697,561 A * 10/1987 Citron ..... F02D 41/0085 123/339.14
4,700,681 A * 10/1987 Hanafusa ..... F02D 41/345 123/478
4,883,038 A * 11/1989 Nakaniwa ..... F02D 41/1498 123/436
5,016,591 A * 5/1991 Nanyoshi ..... F02D 41/1498 123/406.2
5,054,451 A * 10/1991 Kushi ..... F02D 41/32 123/478
5,341,788 A * 8/1994 Uchida ..... 123/692
5,385,129 A * 1/1995 Eyberg ..... F02D 41/0085 123/436
5,728,941 A * 3/1998 Yamamoto ..... G01M 15/11 123/436
5,740,780 A * 4/1998 Shimizu et al. ..... 123/406.22
5,832,404 A * 11/1998 Amano ..... G01M 15/11 123/436
5,950,603 A * 9/1999 Cook et al. ..... 123/520
6,021,758 A * 2/2000 Carey ..... F02D 41/0085 123/406.24
6,209,520 B1 * 4/2001 Kolmanovsky ..... F02D 35/023 123/435
6,662,782 B2 * 12/2003 Iida ..... F02D 41/1458 123/406.47
6,712,042 B1 * 3/2004 Kustosch ..... F02D 37/02 123/406.23
6,843,214 B1 * 1/2005 Herrin ..... F01L 1/022 123/90.15
7,027,910 B1 * 4/2006 Javaherian et al. ..... 701/111
7,500,470 B2 * 3/2009 Buslepp ..... F02D 41/0085 123/436
7,779,802 B2 * 8/2010 Russ ..... 123/90.17
8,051,704 B2 * 11/2011 Kim ..... G01M 15/00 73/114.15
8,360,030 B2 * 1/2013 Walker ..... F02D 41/0085 123/339.1
8,459,105 B2 * 6/2013 Kim et al. ..... 73/114.49
8,695,568 B2 * 4/2014 Yoshikawa ..... 123/436
2003/0164166 A1 * 9/2003 Takeuchi ..... F02D 41/0085 123/674
2005/0205074 A1 * 9/2005 Gibson ..... F02D 13/0207 123/673
2007/0078586 A1 * 4/2007 Pallett ..... B60K 6/445 701/101
2007/0261669 A1 * 11/2007 Buslepp et al. ..... 123/406.24
2008/0133111 A1 * 6/2008 Buslepp ..... F02D 41/0085 701/103
2009/0018756 A1 * 1/2009 Storhok et al. ..... 701/105
2009/0259382 A1 * 10/2009 McKay ..... F02D 41/0085 701/102
2010/0168986 A1 * 7/2010 Iwazaki ..... F02D 41/0085 701/103
2010/0288035 A1 * 11/2010 Arakawa ..... 73/114.03
2011/0137514 A1 * 6/2011 Itabashi ..... B60W 10/06 701/31.4
2011/0231084 A1 9/2011 Nagakura et al.
2012/0209497 A1 * 8/2012 Yoshikawa ..... F02D 41/0085 701/103
2012/0253642 A1 * 10/2012 Kitano ..... F02D 41/0085 701/104
2013/0060449 A1 * 3/2013 Bagnasco ..... F02D 41/0085 701/103
2013/0096805 A1 * 4/2013 Hoshi ..... F02D 41/0085 701/104

FOREIGN PATENT DOCUMENTS

JP 2011-196195 A 10/2011
JP 2012-237279 A 12/2012
JP 2013-011246 A 1/2013
JP 2013011246 A * 1/2013

* cited by examiner

APPARATUS FOR DETECTING IMBALANCE ABNORMALITY IN AIR-FUEL RATIO BETWEEN CYLINDERS IN MULTI-CYLINDER INTERNAL COMBUSTION ENGINE

CROSS-REFERENCES TO RELATED APPLICATIONS

This application claims the benefit of Japanese Patent Application No. 2013-060213, filed Mar. 22, 2013, which is hereby incorporated by reference herein in its entirety.

BACKGROUND OF THE INVENTION

1. Field of the Invention

The present invention relates to an apparatus for detecting imbalance abnormality in an air-fuel ratio between cylinders in a multi-cylinder internal combustion engine, and particularly, to those that can be suitably applied to an internal combustion engine having a plurality of cylinder groups.

2. Description of the Related Art

In general, in an internal combustion engine equipped with an exhaust purifying system using a catalyst, for highly efficiently performing purification of harmful substances in an exhaust gas by the catalyst, it is fundamental to control a mixing ratio of air and fuel in a mixture to be burned in the internal combustion engine, that is, an air-fuel ratio. For controlling such an air-fuel ratio, an air-fuel ratio sensor is provided in an exhaust passage in the internal combustion engine, and feedback control is performed in such a manner as to make the air-fuel ratio detected by the air-fuel ratio sensor be equal to a predetermined target air-fuel ratio.

On the other hand, since the air-fuel ratio control is usually performed applying the same control amount to each of all the cylinders or each bank in a multi-cylinder internal combustion engine, an actual air-fuel ratio may vary between cylinders even if the air-fuel ratio control is performed. When the degree of the imbalance is small at this time, the imbalance can be absorbed by the air-fuel ratio feedback control and the harmful substances in the exhaust gas can be purified also in the catalyst, and the imbalance has no adverse influence on exhaust emissions and raises no particular problem.

However, when the air-fuel ratio varies largely between the cylinders due to a failure of a fuel injection system in a part of the cylinders, the exhaust emission is deteriorated, thus raising a problem. It is desirable to detect the imbalance in the air-fuel ratio as large as to thus deteriorate the exhaust emission, regarding it as imbalance abnormality. Particularly in a case of an internal combustion engine for an automobile, for beforehand preventing a travel of a vehicle in which the exhaust emission has deteriorated, it is requested to detect the imbalance abnormality in the air-fuel ratio between the cylinders on board (so-called OBD; On-Board Diagnostics), and there is recently a movement of legalizing such on-board detection.

For example, in an apparatus described in Japanese Patent Laid-Open No. 2010-112244, a variation parameter representative of the degree of unevenness in variations of a rotation speed of an output shaft in an internal combustion engine is detected, and when it exceeds a predetermined reference value, it is determined that abnormality occurs. Examples of the variation parameter include a rotation speed of the output shaft or a value as a difference in time required for rotation of a predetermined crank angle between neighboring cylinders in ignition order.

In an apparatus described in Japanese Patent Laid-Open No. 2013-011246, a difference in a variation parameter between at least one set of opposing cylinders that are different by 360 degrees in ignition timing from each other is used to determine imbalance abnormality. According to this configuration, it is possible to restrict a measurement error due to product variations in a timing rotor fixed on an output shaft (crankshaft), particularly due to variations in a rotational position of a number of projections formed on a timing rotor peripheral surface.

Incidentally in the internal combustion engine having a plurality of banks as in the case of Japanese Patent Laid-Open No. 2013-011246, even if variations occur in the rotation speed of the output shaft between the opposing cylinders that are different by 360 degrees in ignition timing from each other, in a case where a rotation speed of the output shaft in each cylinder inside each of banks in which the opposing cylinders are disposed is balanced, even in a case where air-fuel ratio feedback control is performed in each bank, an air-fuel ratio of each cylinder in the bank does not deviate largely from a target value, so that deterioration of exhaust emissions is not generated substantially. However, although the deterioration of the exhaust emissions is not substantially generated in such a case, due to variations that occur in the rotation speed of the output shaft between the opposing cylinders that are different by 360 degrees in ignition timing from each other, the variation results in being detected as abnormality.

Therefore, an object of the present invention is to provide an apparatus for detecting imbalance abnormality in an air-fuel ratio between the cylinders in a multi-cylinder internal combustion engine provided with a plurality of cylinder groups configured with a plurality of the cylinders, comprising an imbalance determining unit configured to determine imbalance of an air-fuel ratio of a first cylinder belonging to a cylinder group based upon a difference value between an index value correlative with a crank angular speed detected in the first cylinder and an index value correlative with a crank angular speed detected in a second cylinder belonging to another cylinder group, for restricting determination of the imbalance abnormality in a case where a torque difference exists between the cylinder groups but an index value of each cylinder inside the same cylinder group is equalized.

SUMMARY OF THE INVENTION

According to an aspect of the present invention, there is provided an apparatus for detecting imbalance abnormality in an air-fuel ratio between cylinders in a multi-cylinder internal combustion engine provided with a plurality of cylinder groups configured with a plurality of the cylinders, comprising an imbalance determining unit programmed to determine imbalance in an air-fuel ratio of a first cylinder belonging to a cylinder group based upon a difference value between an index value correlative with a crank angular speed detected in the first cylinder and an index value correlative with a crank angular speed detected in a second cylinder belonging to another cylinder group, and a correction unit programmed to correct the difference value for the first cylinder based upon the index value detected in at least one of other cylinders belonging to the same cylinder group as that of the first cylinder.

According to a different aspect of the present invention, there is provided an apparatus wherein the correction unit is further programmed to correct the difference value for the first cylinder by subtracting the difference value calculated for at least one of other cylinders belonging to the same cylinder group as that of the first cylinder or a value correlative therewith.

Preferably, the correction unit is further programmed to correct the difference value for the first cylinder by subtracting an average value of the difference values calculated for all other cylinders belonging to the same cylinder group as that of the first cylinder.

Preferably, the correction unit is further programmed to correct the difference value for the first cylinder in such a manner as to restrict a component arising from a torque difference between the cylinder groups.

Preferably, the imbalance determining unit is further programmed to compare the difference value for the first cylinder with a predetermined abnormality threshold to determine the imbalance in the air-fuel ratio of the first cylinder, and the correction unit is further programmed to perform guard process such that an amount of correction performed by the correction unit is smaller in an absolute value than the abnormality threshold.

Preferably, the imbalance determining unit is further programmed to determine the imbalance in the air-fuel ratio between the cylinders based upon a difference value of index values correlative with crank angular speeds detected respectively in at least one set of opposing cylinders that belong to the cylinder groups different with each other and are different by 360 degrees in a crank angle with each other.

Further features of the present invention will become apparent from the following description of exemplary embodiments (with reference to the attached drawings).

DESCRIPTION OF THE EMBODIMENTS

Hereinafter, embodiments of the present invention will be explained with reference to the accompanying drawings.

Figure 1:
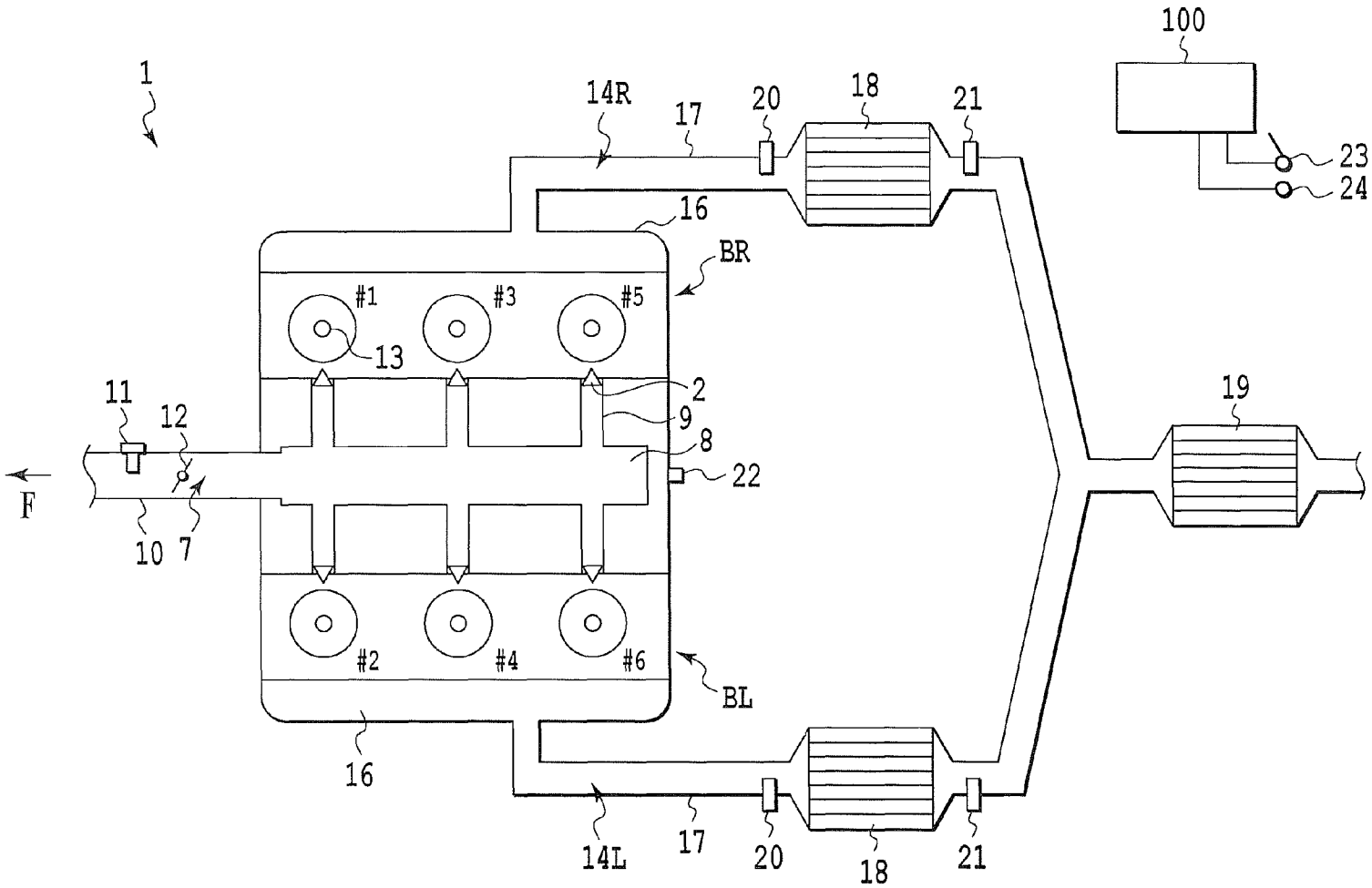
FIG. 1 is a schematic diagram of an internal combustion engine according to a first embodiment of the present invention.

FIG. 1 is a diagram schematically showing an internal combustion engine according to the first embodiment. The illustrated internal combustion engine (engine) 1 is a four-cycle spark ignition type internal combustion engine of a V-type 6-cylinders (gasoline engine) mounted on an automobile. The engine 1 has a right bank BR positioned in the right side as viewed in a forward F direction of the engine and a left bank BL positioned in the left side as viewed in the same direction, wherein cylinders of odd numbers, that is, #1 cylinder, #3 cylinder and #5 cylinder are provided in that order in the right bank BR, and cylinders of even numbers, that is, #2 cylinder, #4 cylinder and #6 cylinder are provided in that order in the left bank BL.

An injector (fuel injection valve) 2 is provided in each cylinder. The injector 2 injects fuel into an intake passage 7, particularly an intake port (not shown) of the corresponding cylinder. It should be noted that the injector may be arranged in such a manner as to inject fuel directly into the cylinder. An ignition plug 13 is provided in each cylinder for igniting a mixture in the cylinder.

The intake passage 7 for introducing intake air includes the intake ports, further, a surge tank 8 as a junction part, an intake manifold 9 connecting the intake port of each cylinder and the surge tank 8, and an intake tube 10 upstream of the surge tank 8. An air flow meter 11 and an electronically controlled throttle valve 12 are provided in the intake tube 10 in that order from the upstream. The air flow meter 11 outputs a signal representative of a magnitude corresponding to an intake flow quantity.

A right exhaust passage 14R is provided to the right bank BR and a left exhaust passage 14L is provided to the left bank BL. The right exhaust passage 14R and the left exhaust passage 14L are merged upstream of a downstream catalyst 19. Since the configurations of exhaust systems upstream of the combined position are identical in both the banks, only components in the side of the right bank BR will be herein explained and those in the side of the left bank BL will be referred to as identical codes in the figures, an explanation of which is omitted.

The right exhaust passage 14R includes exhaust ports (not shown) of #1 cylinder, #3 cylinder and #5 cylinder, an exhaust manifold 16 for collecting exhaust gases in these exhaust ports, and an exhaust tube 17 arranged downstream of the exhaust manifold 16. An upstream catalyst 18 is provided in the exhaust tube 17. A pre-catalyst sensor 20 and a post-catalyst sensor 21 as air-fuel ratio sensors for detecting an air-fuel ratio of an exhaust gas are arranged upstream and downstream (immediately before and immediately after) of the upstream catalyst 18 respectively. In this manner, the upstream catalyst 18, the pre-catalyst sensor 20 and the post-catalyst sensor 21 each are provided to the plurality of the cylinders (or a cylinder group) belonging to the bank of one side. However, without combining the right exhaust passage 14R and the left exhaust passage 14L, an individual downstream catalyst 19 may be provided to them, respectively.

The engine 1 is provided with an electronic control unit (hereinafter referred to as ECU) 100 as a control unit and a detecting unit. The ECU 100 includes a CPU, a ROM, a RAM, input and output ports, a nonvolatile memory device, any of which is not shown, and the like. Besides the aforementioned air flow meter 11, the pre-catalyst sensor 20, and the post-catalyst sensor 21, a crank position sensor 22 for detecting a crank angle or a position of the engine 1, an accelerator opening degree sensor 23 for detecting an accelerator opening degree, a water temperature sensor 24 for detecting a temperature of engine cooling water, and other various sensors (not shown) are connected electrically to the ECU 100 via an A/D converter (not shown) and the like. The ECU 100 controls the injector 2, the ignition plug 13, the throttle valve 12 and the like for a desired output based upon a detection value of each sensor or the like to control a fuel injection quantity, fuel injection timing, ignition timing, a throttle opening degree and the like.

A throttle opening degree sensor (not shown) is provided in the throttle valve 12, and a signal from the throttle opening degree sensor 12 is sent to the ECU 100. The ECU 100 regularly feedback-controls an opening degree of the throttle valve 12 (throttle opening degree) to an opening degree determined corresponding to an accelerator opening degree. In addition, the ECU 100 detects a quantity of intake air per unit time, that is, an intake air quantity, based upon a signal from the air flow meter 11. The ECU 100 detects a load of the engine 1 based upon at least one of the detected accelerator opening degree, the detected throttle opening degree and the detected intake air quantity.

The ECU 100 detects a crank angle itself and detects a revolution number of the engine 1, based upon a crank pulse signal from the crank position sensor 22. Here, "revolution number" means a revolution number per unit time and is the same as a rotation speed.

Figure 2:
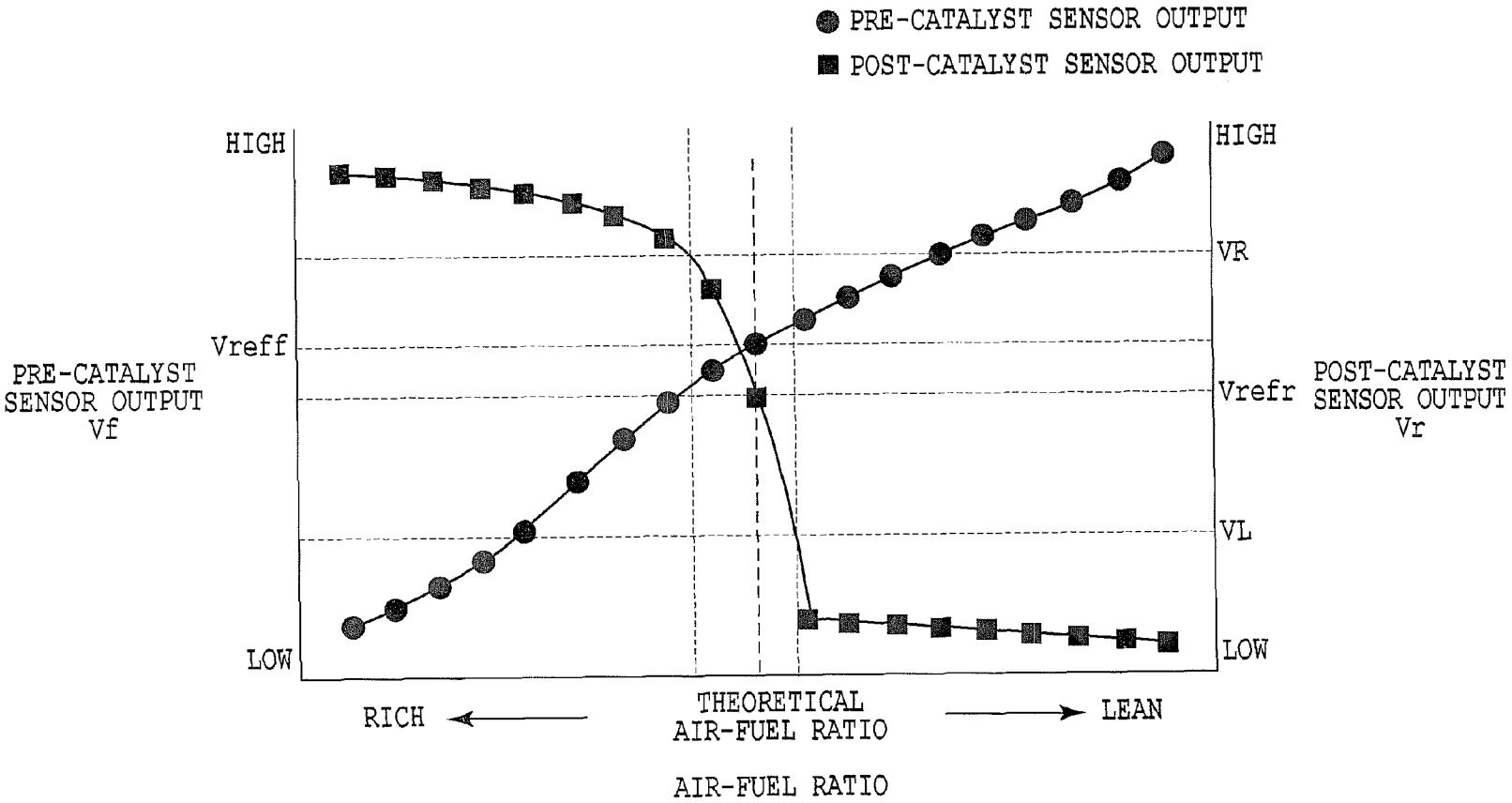
FIG. 2 is a graph showing output characteristics of a pre-catalyst sensor and a post-catalyst sensor.

The pre-catalyst sensor 20 is constructed of a so-called wide-range air-fuel ratio sensor, and can continuously detect air-fuel ratios over a relatively wide range. FIG. 2 shows output characteristics of the pre-catalyst sensor 20. As shown, the pre-catalyst sensor 20 outputs a voltage signal Vf representative of a magnitude proportional to the detected exhaust air-fuel ratio (a pre-catalyst air-fuel ratio A/Ff). When the exhaust air-fuel ratio is a stoichiometric air-fuel ratio (theoretical air-fuel ratio, for example, A/F=14.5), the output voltage is Vreff (for example, about 3.3V).

On the other hand, the post-catalyst sensor 21 is constructed of a so-called $O_2$ sensor, and has the characteristic that an output value rapidly changes across the stoichiometric air-fuel ratio. FIG. 2 shows output characteristics of the post-catalyst sensor 21. As shown, when the exhaust air-fuel ratio (post-catalyst air-fuel ratio A/Fr) is a stoichiometric air-fuel ratio, an output voltage thereof, that is, a stoichiometric equivalent value is Vrefr (for example, 0.45V). The output voltage of the post-catalyst sensor 21 changes within a predetermined range (for example, 0 to 1V). In general, when the exhaust air-fuel ratio is leaner than the stoichiometric air-fuel ratio, the output voltage Vr of the post-catalyst sensor is lower than the stoichiometric equivalent value Vrefr, and when the exhaust air-fuel ratio is richer than the stoichiometric air-fuel ratio, the output voltage Vr of the post-catalyst sensor is higher than the stoichiometric equivalent value Vrefr.

The upstream catalyst 18 and the downstream catalyst 19 are composed of three-way catalysts, and simultaneously purify NOx, HC and CO as harmful ingredients in the exhaust gas when an air-fuel ratio A/F in the exhaust gas flowing into each catalyst is in the vicinity of a stoichiometric air-fuel ratio. A width (window) of the air-fuel ratio in which the three ingredients can be purified simultaneously with high efficiency is relatively narrow.

Therefore, at a regular operating time of the engine, the air-fuel ratio feedback control (stoichiometric control) is performed by the ECU 100 in such a manner that the air-fuel ratio of the exhaust gas flowing into the upstream catalyst 18 is controlled to be in the vicinity of the stoichiometric air-fuel ratio. The air-fuel ratio feedback control is composed of main air-fuel ratio control (main air-fuel ratio feedback control) and auxiliary air-fuel ratio control (auxiliary air-fuel ratio feedback control). In the main air-fuel feedback control, an air-fuel ratio of a mixture (specifically a fuel injection quantity) is feedback-controlled such that the exhaust air-fuel ratio detected by the pre-catalyst sensor 20 is equal to the stoichiometric air-fuel ratio as a predetermined target air-fuel ratio. In the auxiliary air-fuel ratio control, an air-fuel ratio of a mixture (specifically a fuel injection quantity) is feedback-controlled such that the exhaust air-fuel ratio detected by the post-catalyst sensor 21 is equal to the stoichiometric air-fuel ratio.

In the present embodiment, a reference value of the air-fuel ratio is thus set to the stoichiometric air-fuel ratio, and a fuel injection quantity equivalent to the stoichiometric air-fuel ratio (hereinafter referred to as stoichiometric equivalent quantity) is a reference value of the fuel injection quantity. However, the reference value of each of the air-fuel ratio and the fuel injection quantity may be another value.

The air-fuel ratio feedback control is performed by each bank, that is, bank-by-bank. For example, detected values of the pre-catalyst sensor 20 and the post-catalyst sensor 21 in the side of the right bank BR are used only in air-fuel ratio feedback control to #1 cylinder, #3 cylinder, and #5 cylinder belonging to the right bank BR, and are not used in air-fuel ratio feedback control to #2 cylinder, #4 cylinder, and #6 cylinder belonging to the left bank BL. The opposite is likewise applied. The air-fuel ratio control is performed as if two independent in-line three-cylinder engines exist. In the air-fuel ratio feedback control, the same control amount is uniformly used to each cylinder belonging to the same bank.

Figure 3:
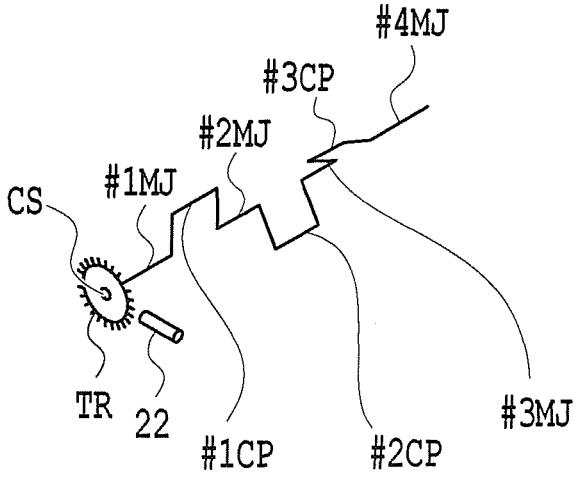
FIG. 3 is a schematic diagram showing an example of a crankshaft in the internal combustion engine according to the first embodiment.

Here, the V-type six-cylinder engine 1 of the first embodiment, as shown in FIG. 3, has a crankshaft CS provided with four main journals of #1 to #4 (#1 MJ to #4 MJ), and three crank pins (#1 CP to #3 CP) between crank throws between the respective main journals. The crankshaft CS is configured such that #1 and #2 crank pins (#1 CP and #2 CP) have a phase difference by 120° around a crank center with each other, and #2 and #3 crank pins (#2 CP and #3 CP) have a phase difference by 120° around a crank center with each other. In the crankshaft CS, large end portions of connecting rods of #1 and #2 cylinders are connected to the #1 crank pin #1CP, and similarly, large end portions of connecting rods of #3 and #4 cylinders are connected to the #2 crank pin #2CP, and large end portions of connecting rods of #5 and #6 cylinders are connected to the #3 crank pin #3CP. In addition, the crankshaft CS is provided with a timing rotor TR on which projections of 34 teeth lacking two teeth are provided, by an interval of 10 degrees respectively, ahead of #1 MJ of the main journal, and the above-mentioned crank position sensor 22 of an electromagnetic pickup type is positioned in a relation to face the projections of the timing rotor TR.

An example of the ignition order in the engine 1 provided with the above-mentioned cylinder arrangement may be that the ignition is performed in the cylinder order of #1, #2, #3, #4, #5 and #6 cylinders, and the ignition interval is an equal interval of 120° CA respectively in the entire engine.

To the ignition of #1, #3 and #5 cylinders in the right bank BR, #4, #6 and #2 cylinders in the left bank BL are ignited after one rotation of the crankshaft, that is, after 360° CA. Therefore, #1 and #4 cylinders, #3 and #6 cylinders, and #5 and #2 cylinders respectively correspond to one set of opposing cylinders in the present invention.

Incidentally, for example, injector(s) 2 belonging to a part (particularly in one cylinder) of all the cylinders may be out of order or the like and an imbalance in an air-fuel ratio between cylinders may occur. For example, it is a case where, due to injection hole clogging or a valve opening failure of the injector 2 provided in a side of the right bank BR, a fuel injection quantity of #1 cylinder is smaller than that of each of the other #3 and #5 cylinders, and an air-fuel ratio of #1 cylinder is shifted to be largely leaner than that of each of the other #3 and #5 cylinders.

If a relatively large correction quantity is applied by the aforementioned air-fuel ratio feedback control even at this time, an air-fuel ratio in the total gases (combined exhaust gases) to be supplied to the pre-catalyst sensor 20 may be controlled to a stoichiometric air-fuel ratio. However, for the air-fuel ratio for each cylinder, the air-fuel ratio in #1 cylinder is largely leaner than the stoichiometric air-fuel ratio and the air-fuel ratio in each of #3 and #5 cylinders is richer than the stoichiometric air-fuel ratio. It is apparent that the air-fuel ratio of all the cylinders results in the stoichiometric air-fuel ratio merely as a balance in the entirety, which is not desirable in view of exhaust emissions. Therefore, the first embodiment is provided with an apparatus for detecting such imbalance abnormality in an air-fuel ratio between cylinders.

Detection of imbalance abnormality in an air-fuel ratio between cylinders in the first embodiment is performed based upon rotation variations of the crankshaft CS. If an air-fuel ratio is shifted largely to a side of being lean in a cylinder, torque generated by combustion is reduced as compared to the case under a stoichiometric air-fuel ratio, and therefore an angular speed (rotation speed Vn) of the crankshaft CS is reduced. Using this event, it is possible to detect the imbalance abnormality in the air-fuel ratio between the cylinders based upon the rotation speed Vn. It should be noted that the similar abnormality detection may be performed using other parameters correlative with the rotation speed Vn (for example, rotation time T required for rotation of a predetermined crank angle including a compression top dead center or the vicinity).

Incidentally if the imbalance in the air-fuel ratio between the cylinders is detected based upon the rotation speed Vn or other parameters (for example, rotation time T) correlative therewith, rotation of the timing rotor TR fixed to the crankshaft CS is detected by the crank position sensor 22 and the rotation speed Vn is calculated based upon the time required for rotating the timing rotor TR by a predetermined angle. In addition, this rotation speed Vn is compared with a value of the other cylinder or a difference between this rotation speed Vn and the value of the other cylinder is calculated, thereby detecting the imbalance abnormality in the air-fuel ratio between the cylinders. However, when variations in the rotation direction position of many projections formed on the peripheral surface of the timing rotor TR are generated due to product variations of the timing rotor TR, this variation possibly leads to detection errors.

Figure 4:
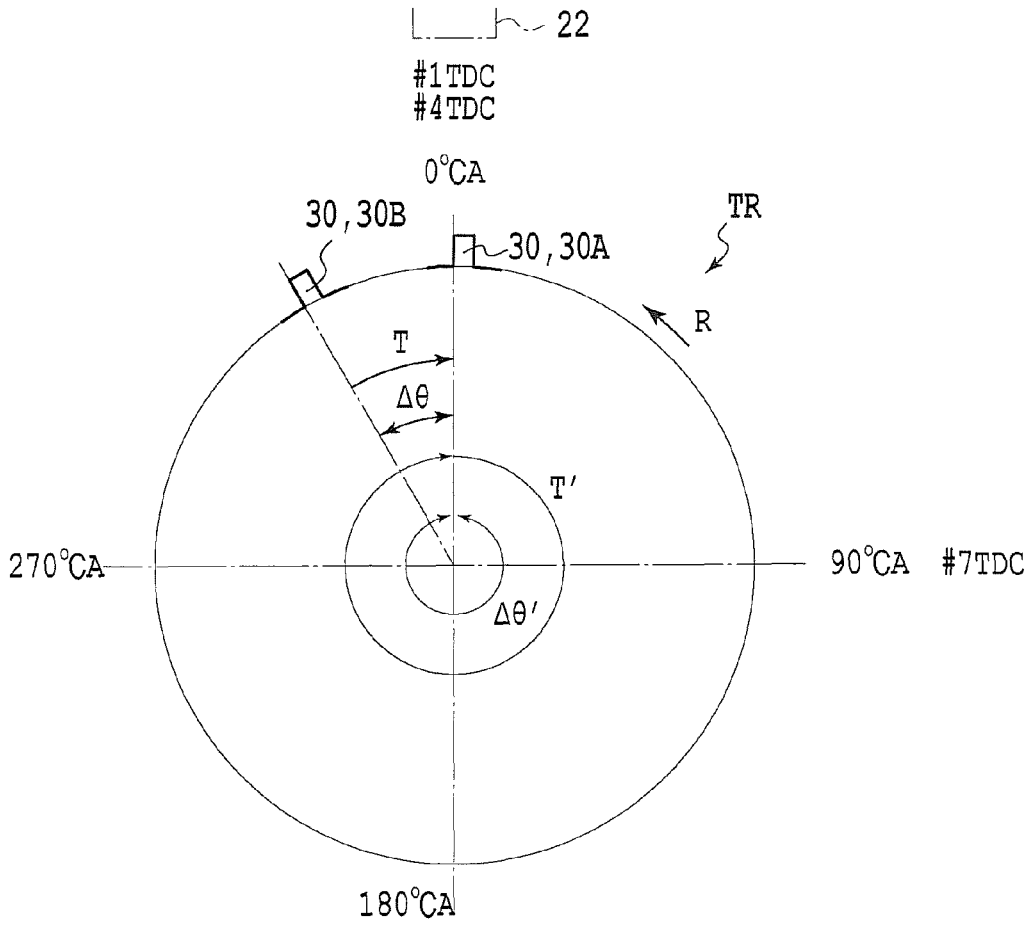
FIG. 4 is a diagram for explaining a timing rotor and a detection method of rotation variations according to the first embodiment.

For example, FIG. 4 shows a position of the timing rotor TR at the time the crank angle is at TDC of #1 cylinder. The rotation direction of the timing rotor TR is indicated at R, and the crank position sensor 22 is indicated by a dashed line. At this position of the timing rotor TR, the crank position sensor 22 detects a tooth or a projection 30A corresponding to TDC of #1 cylinder. For convenience, the position of the projection 30A is defined as a reference, that is, 0° CA. When rotation time T(s) at TDC of #1 cylinder is to be detected, time from a point where a projection 30B positioned by a predetermined angle $\Delta\theta=30°$ CA before the projection 30A is detected by the crank position sensor 22 to a point where the projection 30A is detected by the crank position sensor 22 is detected as rotation time T at TDC of #1 cylinder. In the similar method, rotation time at TDC of #2 cylinder (next ignition cylinder) positioned by 120° CA after TDC of #1 cylinder is detected. A rotation time difference $\Delta T$ of #1 cylinder is detected by subtracting the rotation time at TDC of #1 cylinder from the rotation time at TDC of #2 cylinder.

According to this method, however, the projections 30 in use for detection differ between a case of detecting the rotation time T of #1 cylinder and a case of detecting the rotation time T of #2 cylinder. Therefore when a position of the projection 30 for each product varies due to product variations of the timing rotor TR, a value of the rotation time difference $\Delta T$ of each cylinder detected on the same condition results in varying due to this variation.

Therefore in the present embodiment, based upon a difference between index values correlative with crank angular speeds detected respectively by three different sets of opposing cylinders that belong to banks different with each other and are different by 360° in a crank angle with each other, the imbalance in the air-fuel ratio between the cylinders is determined. That is, from a crank angular speed at a point where the projection 30A is detected by the crank position sensor 22, a crank angular speed at a point where the same projection 30A positioned by a predetermined angle $\Delta\theta'=360°$ (one rotation) after the projection 30A is detected by the crank position sensor 22 is detected is subtracted, and the thus obtained value is defined as a rotation variation index value for #1 cylinder. The same projection 30A after 360° CA corresponds to TDC of #4 cylinder.

In this way, in the first embodiment, the single same projection 30A alone is used for detecting rotation speed V1 of #1 cylinder and rotation speed V4 of #4 cylinder. It is not necessary to consider the deviation of the projection 30A for each product. In total only three projections 30, which are spaced by 120° CA respectively from each other, are used for detecting rotation speeds Vn of all the cylinders. Accordingly, it is possible to restrict variations in the detection value of the rotation variation index value due to the product variation of the timing rotor TR to improve detection accuracy.

An operation of the first embodiment as configured above will be explained. In the first embodiment, at a regular operating time of the engine, the ECU 100 performs the aforementioned air-fuel ratio feedback control and detection of the imbalance abnormality in the air-fuel ratio between the cylinders respectively in parallel and continuously.

Figure 5:
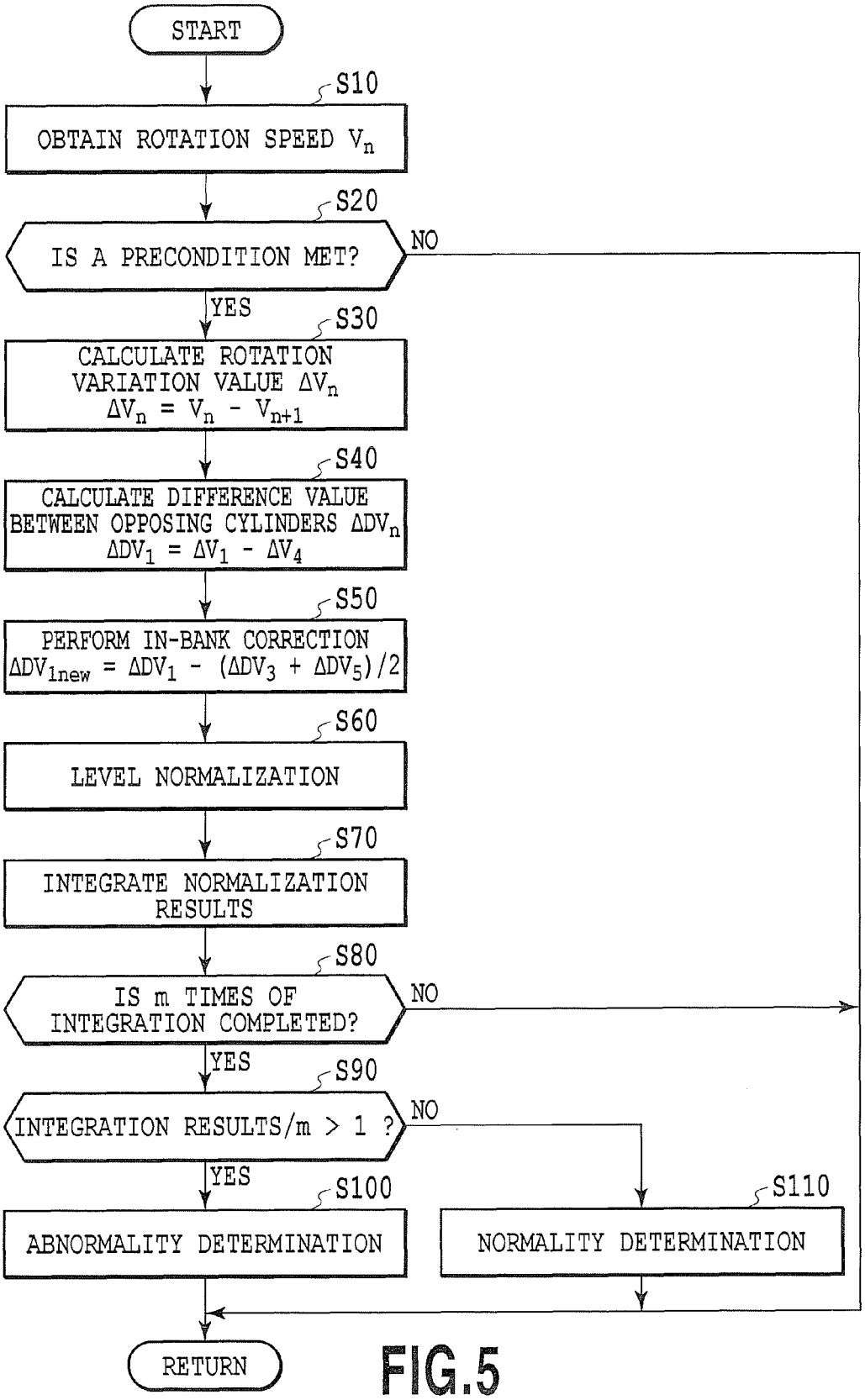
FIG. 5 is a flow chart showing the procedure of processing for determining imbalance in an air-fuel ratio between cylinders according to the first embodiment.

FIG. 5 is a flow chart showing a detection routine of the imbalance abnormality in an air-fuel ratio between cylinders. This routine is, for example, repeatedly executed for each predetermined sample cycle T by the ECU 100.

Figure 6:
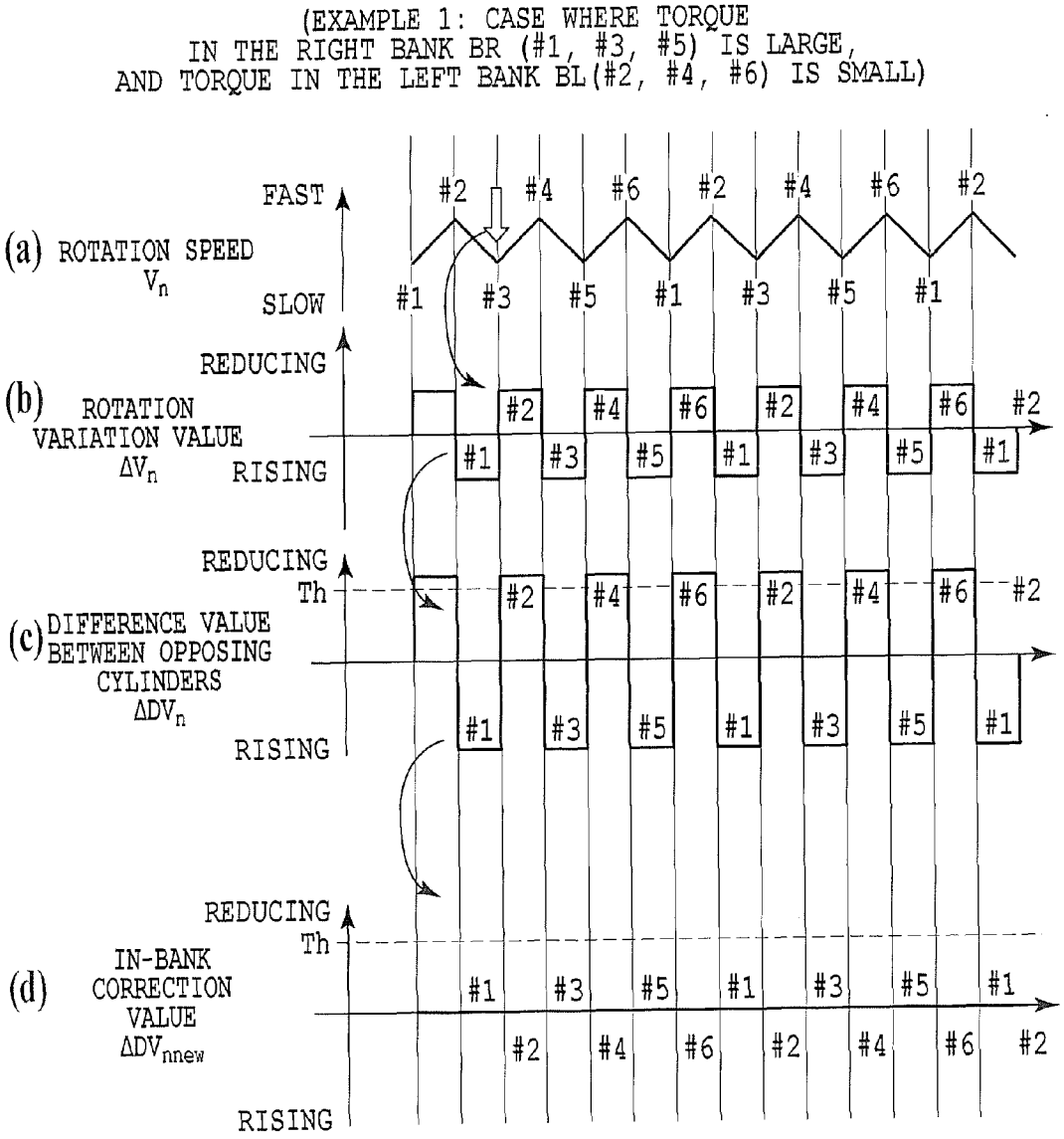
FIG. 6 is a timing chart showing a first execution example of the processing for determining the imbalance in the air-fuel ratio between the cylinders according to the first embodiment.

First, at step 10 the ECU 100 obtains a rotation speed Vn (n is a cylinder number; the same shall apply hereafter) for each cylinder based upon a signal from the crank position sensor 22. In the engine 1 of the present embodiment, the ignition order corresponds to, as mentioned above, the cylinder order of #1, #2, #3, #4, #5 and #6 cylinders, and, for example, a rotation speed V1 of #1 cylinder is calculated as an angular speed during a period from TDC (compression top dead center) of #1 cylinder to TDC of #2 cylinder. Here, for example, when torque of the right bank BR (#1, #3 and #5 cylinders) is relatively large and torque of the left bank BL (#2, #4 and #6 cylinders) is relatively small, a rotation speed Vn at each TDC is pulsatile as shown in FIG. 6(*a*). It should be noted that in FIG. 6 (*a*), each cylinder number of #1 to #6 cylinders indicates a point where each cylinder comes to TDC. Accordingly, the rotation speed Vn is minimized at each point where the cylinder numbers of #1, #3 and #5 cylinders are marked (when plotted at TDC, the rotation speed Vn increases after ignition and comes to a maximum at each point where the cylinder numbers of #2, #4 and #6 cylinders are marked).

At next step 20 the ECU 100 determines whether or not a predetermined precondition suitable for performing abnormality detection is met. The precondition is met when the following respective conditions are all met.

(1) Warning-up of the engine 1 is finished. For example, when a water temperature detected by a water temperature sensor 24 is a predetermined value or more, it is determined that the warming-up is finished.

(2) The engine 1 is in a steady operation. For example, in a case where the engine 1 is not in rapid acceleration or in rapid deceleration, it is determined that the engine 1 is in the steady operation.

(3) The engine 1 is operating within a detection region. For example, when both a throttle opening degree and an engine rotation speed are within their respective predetermined regions, it is determined that the engine 1 is within the detection region.

(4) Air-Fuel Ratio Feedback Control is in Process.

If the precondition is not met, the present routine ends. On the other hand, if the precondition is met, at step S30 a rotation variation value ΔVn is calculated. The rotation variation value ΔVn discussed here is a value (ΔVn=Vn−Vn+1) found by subtracting, from a rotation speed Vn of a cylinder, a rotation speed Vn+1 in a cylinder ignited immediately thereafter. For example, when a rotation speed V3 of #3 cylinder is obtained, at that point a rotation variation value ΔV2 of #2 cylinder is calculated (ΔV2=V2−V3). The purpose of using a difference value between cylinders neighboring in the ignition order as the rotation variation value ΔVn is to exclude an influence of a transient state such as during acceleration or deceleration. The rotation variation value ΔVn calculated in this way is, as shown in FIG. 6(*b*), generated as a positive value for a cylinder in which the torque or the rotation speed Vn is reduced due to misfire or closed fixation of the injector 2, and is generated as a negative value for a cylinder in which the rotation speed is relatively high.

When the rotation variation value ΔVn is thus calculated, at next step S40 a difference value between opposing cylinders ΔDVn is calculated. The difference value between the opposing cylinders ΔDVn discussed here is a difference value between an index value correlative with a crank angular speed detected of a first cylinder belonging to a cylinder group (bank) and an index value correlative with a crank angular speed detected of a second cylinder belonging to another cylinder group (bank). In the present embodiment, the second cylinder is an opposing cylinder that is belonging to a cylinder group (bank) different from that of the first cylinder and a crank angle of which is different by 360° from that of the first cylinder. By thus using the difference of the rotation variation value ΔVn between the opposing cylinders for imbalance determination, it is possible to restrict a measurement error due to the product variations of the timing rotor fixed on the crankshaft, particularly variations in a rotational position of a number of projections formed on the peripheral surface of the timing rotor. The difference value between the opposing cylinders ΔDVn is calculated according to the following equations, respectively.

$$\Delta DV_1=\Delta V_1-\Delta V_4$$

$$\Delta DV_2=\Delta V_7-\Delta V_5$$

$$\Delta DV_3=\Delta V_3-\Delta V_6$$

$$\Delta DV_4=\Delta V_4-\Delta V_1$$

$$\Delta DV_5=\Delta V_5-\Delta V_2$$

$$\Delta DV_6=\Delta V_6-\Delta V_3$$

Next, at step S50 in-bank correction is made. This in-bank correction is a process for correcting the difference value between the opposing cylinders ΔDVn for a first cylinder (for example, #1 cylinder) using an index value detected from at least one of the other cylinders (for example, #3 cylinder and #5 cylinder) belonging to the same cylinder group (bank) as that of the first cylinder. Particularly in the present embodiment, correction of a difference value between the opposing cylinders ΔDVn is performed by subtracting, from the difference value Between the opposing cylinders ΔDVn for the first cylinder (for example, #1 cylinder), an average value of difference values between opposing cylinders ΔDVn calculated for all other cylinders (#3 cylinder and #5 cylinder) belonging to the same cylinder group (for example, the right bank BR) as that of the first cylinder. Specifically the in-bank correction is made according to the following equations, respectively.

$$\Delta DV_{1new}=\Delta DV_1-(\Delta DV_3+\Delta DV_5)/2$$

$$\Delta DV_{2new}=\Delta DV_2-(\Delta DV_4+\Delta DV_6)/2$$

$$\Delta DV_{3new}=\Delta DV_3-(\Delta DV_1+\Delta DV_5)/2$$

$$\Delta DV_{4new}=\Delta DV_4-(\Delta DV_2\Delta DV_6)/2$$

$$\Delta DV_{5new}=\Delta DV_5-(\Delta DV_1+\Delta DV_3)/2$$

$$\Delta DV_{6new}=\Delta DV_6-(\Delta DV_2+\Delta DV_4)/2$$

When the in-bank correction is thus made, at next step S60, the ECU 100 performs level normalization of the difference value between the opposing cylinders $\Delta DVn_{new}$. This level normalization is a value found, for example, by dividing the difference value between the opposing cylinders ΔDVn corresponding to an imbalance determination threshold by the difference value between the opposing cylinders ΔDVn of each cylinder calculated at step S50, and corresponds to a ratio when the imbalance determination threshold is regarded as one. The values normalized in this way are integrated at the next step S70, and the above processing is repeated until the integration of m times is completed (S80).

When the integration of m times of the normalized values is completed, finally at step S90 it is determined whether an average value found by dividing the integration result by the number of times of the integration (=m) exceeds the imbalance determination threshold (=1), as the imbalance determination. If the positive determination is made at step S90, abnormality determination is made (S100), and if the negative determination is made at step S90, normality determination is made (S110). Processes so far are executed individually in the respective cylinders.

When the abnormality determination is made at step S100, for informing a driver that the imbalance abnormality in the air-fuel ratio between the cylinders is detected, for example, a warning lamp provided in a front panel in a driver's seat is lit, and the event that the abnormality has occurred and the number of the abnormal cylinder are stored in a readable state to a maintenance worker in a predetermined diagnosis memory region in a nonvolatile memory device of the ECU 100. Thereby the imbalance abnormality detection processing in FIG. 5 ends.

For example, as shown in FIG. 6, suppose that the torque of the right bank BR (#1, #3 and #5) is relatively large and the torque of the left bank BL (#2, #4 and #6) is relatively small, and a torque difference between banks exists, but the imbalance in an air-fuel ratio does not exist with no torque difference between cylinders inside each bank. In such a case, with a conventional apparatus not improved by the present invention, the difference value between the opposing cylinders ΔDVn arising from the torque difference between the banks, as shown in FIG. 6(C), exceeds a value Th corresponding to the imbalance determination threshold and may be erroneously determined as abnormality. In contrast to this, in the present embodiment, an in-bank correction process (step S50) is performed for correcting the difference value between the opposing cylinders ΔDVn for the first cylinder (for example, #1 cylinder) using an index value detected in at least one of other cylinders (for example, #3 cylinder and #5 cylinder) belonging to the same cylinder group (bank) as that of the first cylinder. Therefore, if the index values of all cylinders inside the same cylinder group (bank) are equalized (the index value of each cylinder is within a predetermined range from the average value), the difference value between the opposing cylinders ΔDVn does not exceed the value Th corresponding to the threshold as shown in FIG. 6(*d*), and it is possible to restrict abnormality determination.

Figure 7:
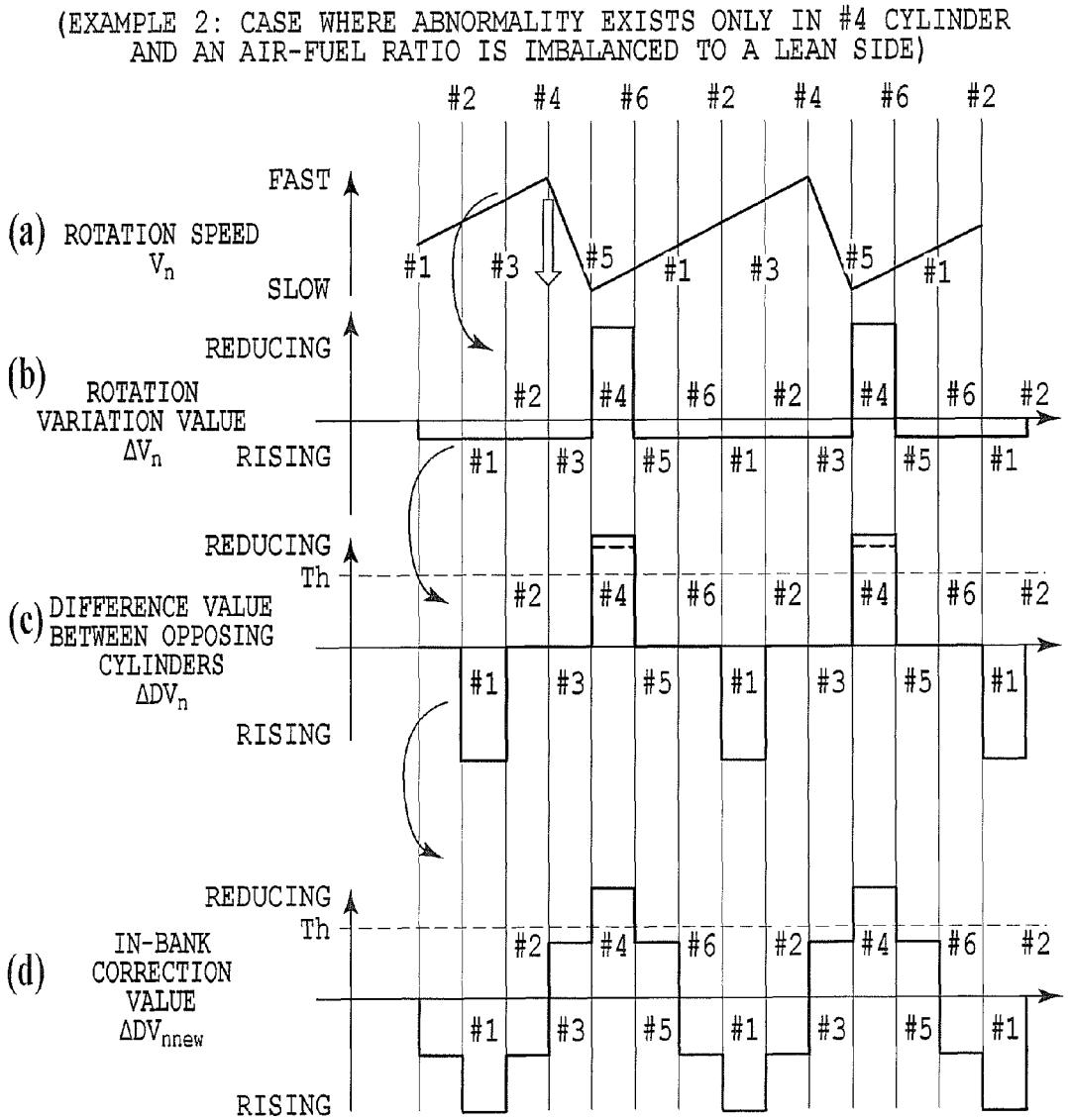
FIG. 7 is a timing chart showing a second execution example of the processing for determining the imbalance in the air-fuel ratio between the cylinders according to the first embodiment.

In contrast to this, if for example, as shown in FIG. 7, the abnormality exists only in #4 cylinder and the air-fuel ratio is imbalanced to a lean side, then based upon the rotation speed Vn detected as shown in FIG. 7(*a*), the rotation variation value ΔVn is calculated as shown in FIG. 7(*b*), the difference value between the opposing cylinders ΔDVn is calculated as shown in FIG. 7(*c*), and further, the in-bank correction process is executed as shown in FIG. 7(*d*) similarly. As a result, the in-bank correction value $\Delta DV4_{new}$ for #4 cylinder in which the abnormality exists exceeds the value Th corresponding to the imbalance determination threshold, and the abnormality determination is correctly made. That is, only a component arising from the torque difference between the cylinder groups is cancelled by the in-bank correction process, while a component arising from the imbalance abnormality in the air-fuel ratio between the cylinders is not cancelled to be appropriately detected.

As thus described, in the first embodiment, the ECU 100 executes the in-bank correction process (step S50) to the difference value between the opposing cylinders ΔDVn for the first cylinder (for example, #1 cylinder). Therefore, if the torque difference exists between the cylinder groups (banks) but the index values of all cylinders inside the same cylinder group (bank) are equalized, the component arising from the torque difference between the cylinders is cancelled by the in-bank correction process, making it possible to restrict imbalance abnormality determination.

It should be noted that in the in-bank correction process (step S50) in the first embodiment, the difference value Between the opposing cylinders ΔDVn for the first cylinder is corrected, by subtracting the average value of the difference values between opposing cylinders ΔDVn calculated for all the other cylinders belonging to the same cylinder group as that of the first cylinder. However, in the in-bank correction process of the present invention, various modifications can be thought up as processing of correcting the difference value between the opposing cylinders ΔDVn for the first cylinder in such a manner as to restrict the component arising from the torque difference between the cylinders. For the correction, in addition to the difference value between the opposing cylinders ΔDVn for other cylinders belonging to the same cylinder group as that of the first cylinder, one can use difference value(s) between opposing cylinders ΔDVn for cylinder(s) belonging to a cylinder group different from that of the first cylinder.

For example, a first modification of the in-bank correction process includes a method where ΔDVn for a first cylinder (for example, #1 cylinder) is corrected by subtracting a difference value between opposing cylinders ΔDVn for another cylinder (for example, #5 cylinder) belonging to the same bank, and then subtracting a difference between difference values between opposing cylinders ΔDVn for two cylinders (for example, #4 and #2 cylinders) belonging to another bank ($\Delta DV_{1new}=\Delta DV_1-\Delta DV_5-(\Delta DV_4-\Delta DV_2)$).

In addition, a second modification of the in-bank correction process includes a method where ΔDVn for a first cylinder (for example, #1 cylinder) is corrected by subtracting an average value of difference values between opposing cylinders ΔDVn for all other cylinders (for example, #3 and #5 cylinders) belonging to the same bank, and then subtracting a result of the similar calculation for three cylinders (for example, #2, #4 and #6 cylinders) belonging to another bank ($\Delta DV_{1new}=\Delta DV_1-(\Delta DV_3+\Delta DV_5)/2-(\Delta DV_7-(\Delta DV_4+\Delta DV_6)/2)$).

Any of the correction process in the first embodiment, and in the first and second modifications, can be considered as an equivalent of a frequency filter having characteristics of cancelling or masking bank-to-bank pulsation (i.e. rotational 1.5-order components) in the waveform made up of the difference value between the opposing cylinders ΔDVn. The effect similar to that of the first embodiment can be obtained by these modifications. However, considering the calculation load and the detection performance totally, the method of the first embodiment is more suitable for implementation than the methods of the first and second modifications.

In addition, the present invention can be, as long as an internal combustion engine has a plurality of cylinder groups, applied also to other multi-cylinder engines such as eight-cylinder, ten-cylinder and 12-cylinder engine. For example, in a case where in an eight-cylinder engine of two banks, cylinders of odd numbers, that is, #1, #3, #5 and #7 cylinders are provided in that order in the right bank BR, and cylinders of even numbers, that is, #2, #4, #6, and #8 cylinders are provided in that order in the left bank BL, wherein #1 and #6, #8 and #5, #7 and #4, and #3 and #2 cylinders respectively are one set of opposing cylinders defined in the present invention, the in-bank correction process (step S50) can be respectively executed as follows.

$$\Delta DV_{1new}=\Delta DV_1-(\Delta DV_3+\Delta DV_5+\Delta DV_7)/3$$

$$\Delta DV_{2new}=\Delta DV_2-(\Delta DV_4+\Delta DV_6+\Delta DV_8)/3$$

$$\Delta DV_{3new}=\Delta DV_3-(\Delta DV_1+\Delta DV_5+\Delta DV_7)/3$$

$$\Delta DV_{4new}=\Delta DV_4-(\Delta DV_2+\Delta DV_6+\Delta DV_8)/3$$

$$\Delta DV_{5new}=\Delta DV_5-(\Delta DV_1+\Delta DV_3+\Delta DV_7)/3$$

$$\Delta DV_{6new}=\Delta DV_6-(\Delta DV_2+\Delta DV_4+\Delta DV_8)/3$$

In the first embodiment as described above, the in-bank correction process (step S50) is executed by correcting the difference value between the opposing cylinders ΔDVn for the first cylinder by subtracting the difference value between the opposing cylinders ΔDVn calculated for at least one of other cylinders belonging to the same cylinder group as that of the first cylinder or the value correlative therewith. Therefore, a desired effect of the present invention can be obtained by a simple calculation.

Next, a second embodiment of the present invention will be hereinafter explained. In the above-mentioned first embodiment, when the in-bank correction process is executed as shown in FIG. 7 (*d*) at step S50, for the cylinders (for example, #3 and #5 cylinders) neighbored in ignition order to the cylinder where the abnormality exists, a component arising from the in-bank correction process is generated in the in-bank correction value $\Delta DVn_{new}$ although it does not exist in the difference value Between the opposing cylinders ΔDVn This component has no problem when it is smaller than a value Th corresponding to the imbalance determination threshold as shown in FIG. 7(*d*), but if it exceeds the value Th, there occur a plurality of cylinders on which the abnormality is determined, which leads to necessity of additional analysis for determining a true abnormal cylinder out of them. Therefore, the second embodiment that will be hereinafter explained has an object of restricting an unnecessary component arising from the in-bank correction process that would be generated in the in-bank correction value $\Delta DVn_{new}$ for the cylinder where the abnormality does not exist. It should be noted that since the second embodiment has a mechanical configuration in common to the apparatus in the first embodiment, and is only different in control from the first embodiment as follows, identical codes are assigned to components in the second embodiment, and the detailed explanation is omitted.

Figure 8:
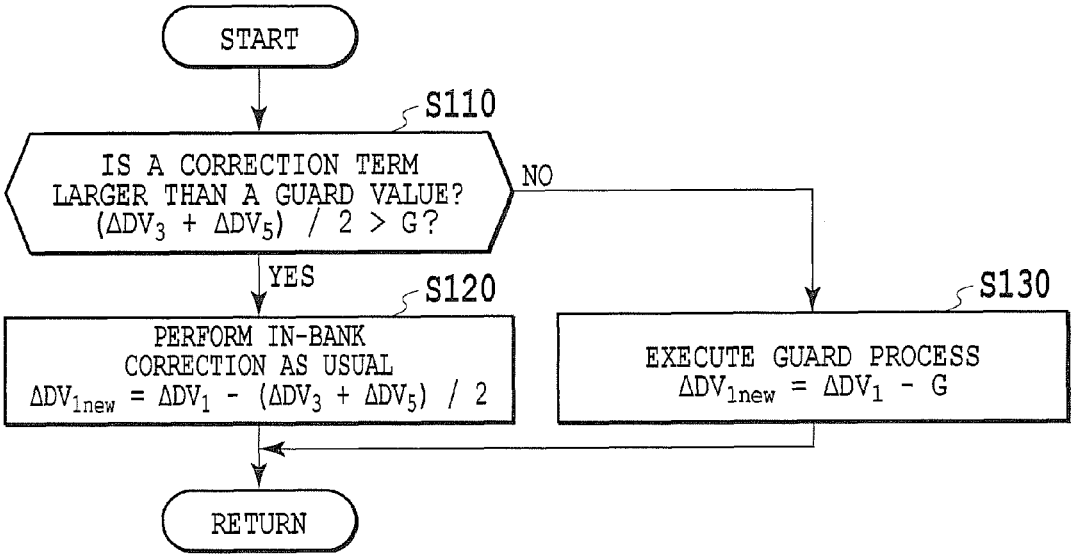
FIG. 8 is a flow chart showing a part relating to in-bank correction process and guard process, among processing for determining imbalance in an air-fuel ratio between cylinders according to a second embodiment of the present invention.
Figure 9:
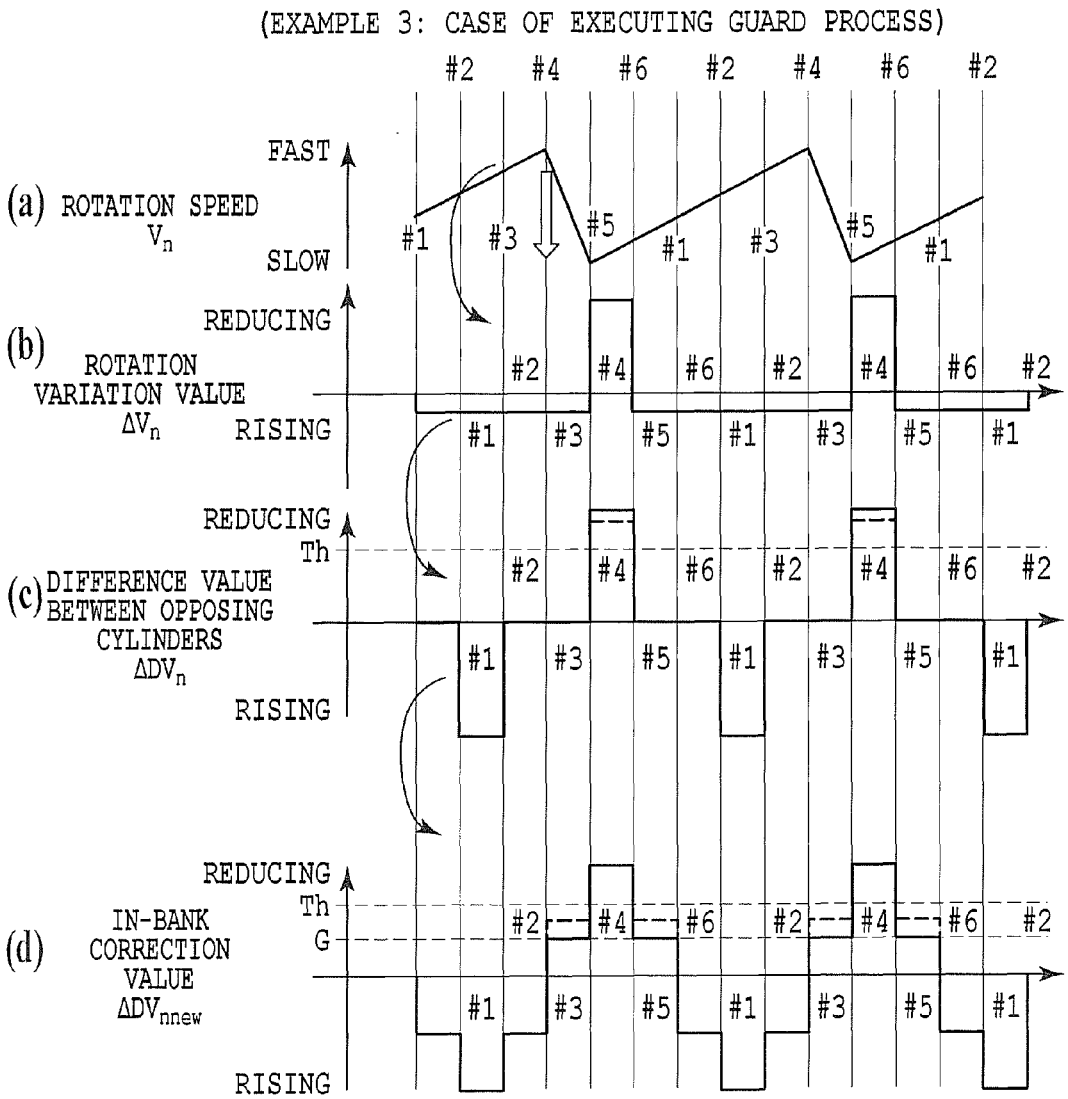
FIG. 9 is a timing chart showing an execution example of the processing for determining the imbalance in the air-fuel ratio between the cylinders according to the second embodiment.

In the ECU 100 in the second embodiment, processing relating to a sub routine shown in FIG. 8 is executed, in place of step S50 in the detection routine for the imbalance abnormality in the air-fuel ratio between the cylinders in the above first embodiment, that is, in place of the in-bank correction process.

In FIG. 8, first, the ECU 100 determines whether a correction term relating to the above in-bank correction is larger than a predetermined guard value G (step S110). The correction term herein is found by dividing a sum of difference values between opposing cylinders ΔDVn for all other cylinders belonging to the same cylinder group (bank) as that of a target cylinder, by the number of the all other cylinders (for example, when the target cylinder is #1 cylinder, $(\Delta DV_{3+}\Delta DV_5)/2$). In addition, this guard value G may be the value Th corresponding to the imbalance determination threshold, or a value slightly smaller in consideration of an allowance amount or a non-sensitivity region to the value Th, for example, ½ of the value Th corresponding to the imbalance determination threshold. The guard value G may be a fixed value, or may be obtained as a variable or dynamic value with a map having input variables of an engine rotation speed Ne and a load or an intake air quantity KL.

if at step S110 the positive determination is made, that is, the correction term is larger than the guard value G (that is, the amount of correction performed by the in-bank correction process is smaller in an absolute value than the abnormality threshold), the guard process is not required. Therefore the routine goes to step S120, wherein the in-bank correction process is executed according to Equation 1 in the above first embodiment as usual.

If at step S110 the negative determination is made, that is, the correction term is equal to or less than the guard value G (that is, the amount of correction performed by the in-bank correction process is equal to or larger in an absolute value than the abnormality threshold), the guard process is required. Therefore the routine goes to step S130, wherein the guard process for the correction term is executed. The guard process uses the guard value G for the amount of correction to be performed by the in-bank correction process ($(\Delta DVn_{new}=\Delta DVn-G)$).

When the process of step S120 or step S130 is finished, the subsequent processes are executed similarly to the processes following step S60 in the detection routine of the imbalance abnormality in the air-fuel ratio between the cylinders in the first embodiment shown in FIG. 5.

As a result of the above processes, in the second embodiment, the guard process is executed such that the amount of correction performed by the in-bank correction process is made smaller in an absolute value than the value Th corresponding to the imbalance determination threshold. Accordingly, the second embodiment can restrict the unnecessary component arising from the in-bank correction process that would be generated in the in-bank correction value $\Delta DVn_{new}$ for the cylinder in which the abnormality does not exist.

The details of the preferred embodiments in the present invention are thus explained, but embodiments in the present invention are not limited to the above-mentioned embodiments, and the present invention includes all modifications, all adaptations and equivalents encompassed in the spirit of the present invention defined by the claims. Therefore the present invention should not be interpreted in a limiting manner and can be applied to other arbitrary technologies encompassed within a range of the spirit of the present invention.

For example, in each of the above embodiments, the air-fuel ratio imbalance between the cylinders is determined based upon the difference value of the index values correlative with the crank angular speeds detected in one set of the opposing cylinders respectively the crank angles of which are different by 360° with each other, but this configuration is not necessarily required, and the present invention can be widely applied to the configuration of performing the imbalance determination based upon a difference value of index values between a plurality of cylinders belonging to different cylinder groups. The value as the difference between cylinders neighbored in ignition order may not be used as the rotation variation value ΔVn, and the rotation speed Vn may be used as the index value instead.

In addition, for improving detection sensitivity of the imbalance abnormality in the air-fuel ratio, a fuel injection quantity of a predetermined target cylinder may be actively or forcibly increased or decreased, and the imbalance abnormality may be detected based upon rotation variations of the target cylinder after the increase or decrease. The forcible increase or decrease of the fuel injection quantity in this case is preferably performed by a common quantity for one set of cylinders as opposing cylinders or each set out of a plurality of sets of cylinders.

The present invention is not limited to the V-type 6-cylinder engine, but may be applied also to engines of other cylinder numbers, and other type engines having a plurality of banks, that is, cylinder groups, for example, a horizontal opposed engine, and these types of engines are also encompassed in the scope of the present invention.

What is claimed is:

1. An apparatus for detecting imbalance abnormality in an air-fuel ratio between cylinders in a multi-cylinder internal combustion engine provided with a plurality of cylinder groups configured with a plurality of the cylinders, comprising:

an imbalance determining unit programmed to determine imbalance in an air-fuel ratio of a first cylinder belonging to a cylinder group based upon a difference value between an index value correlative with a crank angular speed detected in the first cylinder and an index value correlative with a crank angular speed detected in a second cylinder belonging to another cylinder group; and a correction unit programmed to correct the difference value for the first cylinder by subtracting the difference value calculated for at least one of other cylinders belonging to the same cylinder group as that of the first cylinder or a value correlative therewith or by subtracting an average value of the difference values calculated for all other cylinders belonging to the same cylinder group as that of the first cylinder wherein a notification is provided to the user if an imbalance in the air-fuel ratio between the first cylinder and the second cylinder is detected.

2. An apparatus according to claim 1, wherein the imbalance determining unit is further programmed to compare the difference value for the first cylinder with a predetermined abnormality threshold to determine the imbalance in the air-fuel ratio of the first cylinder, and the correction unit is further programmed to perform guard process such that an amount of correction performed by the correction unit is smaller in an absolute value than the abnormality threshold.

3. An apparatus according to claim 1, wherein the imbalance determining unit is further programmed to determine the imbalance in the air-fuel ratio between the cylinders based upon a difference value of index values correlative with crank angular speeds detected respectively in at least one set of opposing cylinders that belong to the cylinder groups different with each other and are different by 360 degrees in a crank angle with each other.

* * * * *

UNITED STATES PATENT AND TRADEMARK OFFICE

CERTIFICATE OF CORRECTION

PATENT NO. : 9,279,378 B2
APPLICATION NO. : 14/186043
DATED : March 8, 2016
INVENTOR(S) : Akihiro Katayama et al.

It is certified that error appears in the above-identified patent and that said Letters Patent is hereby corrected as shown below:

Specification

In Column 10, Line 23, delete

"$\Delta DV_{4new}=\Delta DV_4-(\Delta DV_2\Delta DV_6)/2$"

and insert

--$\Delta DV_{4new} = \Delta DV_4 - (\Delta DV_2 + \Delta DV_6) /2$--, therefor.

In Column 12, Lines 13 & 14, delete

"$(\Delta DV_{1new}=\Delta DV_1-(\Delta DV_3+\Delta DV_5)/2-(\Delta DV_7-(\Delta DV_4+\Delta DV_6)/2))$."

and insert

--$(\Delta DV_{1new} = \Delta DV_1 - (\Delta DV_3 + \Delta DV_5) /2 - (\Delta DV_2 - (\Delta DV_4 + \Delta DV_6) /2))$.--, therefor.

In Column 13, Lines 30 & 31, delete

"$(\Delta DV_{3+} \Delta DV_5)/2)$."

and insert

--$(\Delta DV_3 + \Delta DV_5) /2)$.--, therefor.

Signed and Sealed this
Seventh Day of June, 2016

Michelle K. Lee

Michelle K. Lee
*Director of the United States Patent and Trademark Office*